United States Patent [19]

Reidy

[11] 4,071,214

[45] Jan. 31, 1978

[54] HOLDER FOR PAINT CANS AND THE LIKE

[76] Inventor: Robert A. Reidy, Lee Road, Somers, N.Y. 10589

[21] Appl. No.: 695,823

[22] Filed: June 14, 1976

[51] Int. Cl.[2] ..... E06C 7/14

[52] U.S. Cl. ..... 248/211; 224/45 C

[58] Field of Search ..... 224/45 C, 45 W; 248/210, 211, 238, 311.1; 211/119; 215/227

[56] References Cited

U.S. PATENT DOCUMENTS

| | | | |
|---|---|---|---|
| 1,031,310 | 7/1912 | Youngblood | 248/311.1 |
| 1,086,541 | 2/1914 | Lailer | 248/311.1 |
| 2,318,930 | 5/1943 | Deitrich | 248/210 |
| 2,466,840 | 4/1949 | Crawford | 248/210 |
| 3,001,751 | 9/1961 | Bozik | 248/210 |
| 3,108,776 | 10/1963 | Cook | 248/210 |
| 3,448,956 | 6/1969 | Kuhaneck, Jr. | 248/210 |
| 3,568,969 | 3/1971 | Boman et al. | 248/311.1 |
| 3,738,601 | 6/1973 | Gehringer | 248/210 |
| 3,814,364 | 6/1974 | Gargaro | 248/210 |
| 3,895,772 | 7/1975 | Ellingson | 248/210 |

*Primary Examiner*—Trygve M. Blix
*Assistant Examiner*—Kenneth Noland
*Attorney, Agent, or Firm*—Karl H. Gross

[57] ABSTRACT

A holder for cans of paint and the like has a receptacle for a can and two hooks extending from the receptacle. One of the hooks extends upwardly from the receptacle and serves to be hooked over one rung of a ladder so as to suspend the receptacle therefrom; the other hook projects laterally outwardly from the receptacle and serves for hooking over a different rung of the ladder so as to stabilize the suspended receptacle relative thereto.

4 Claims, 2 Drawing Figures

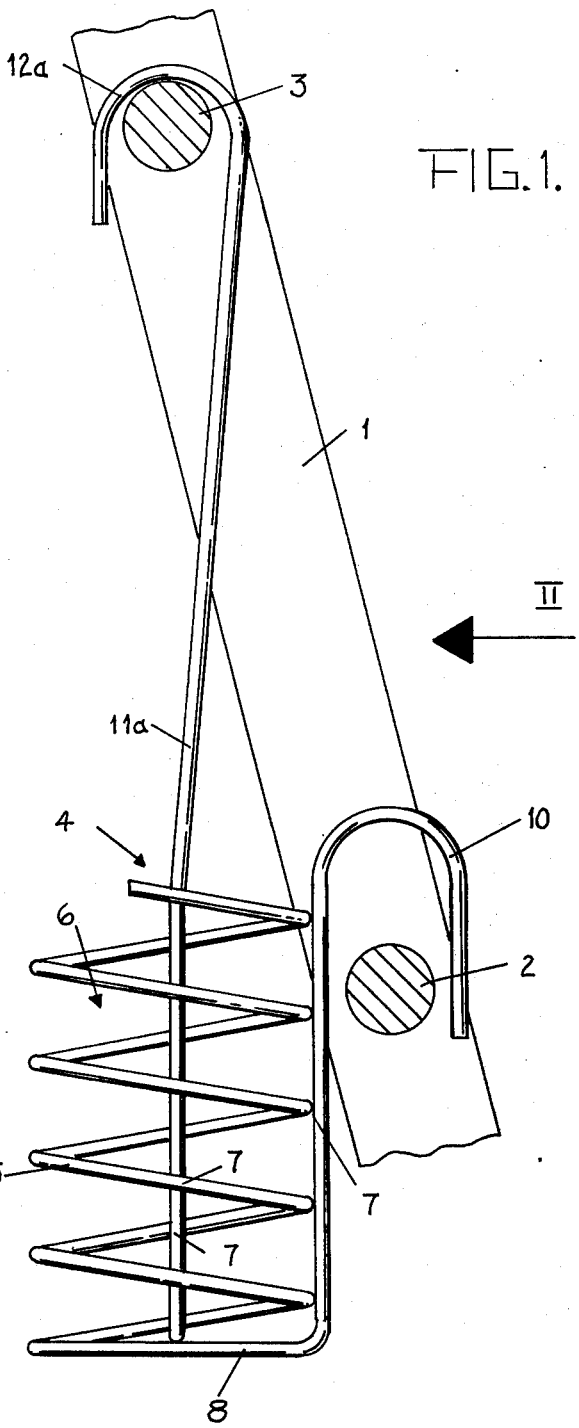
FIG. 1.
FIG. 2.
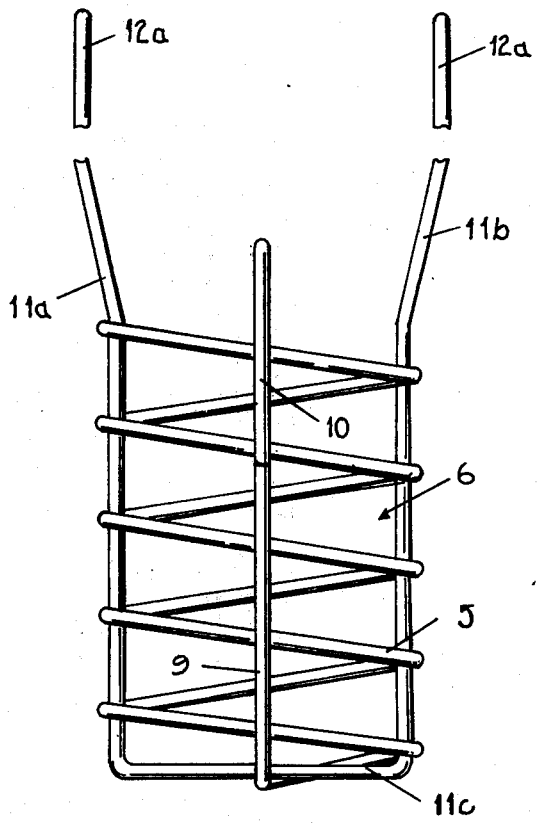

HOLDER FOR PAINT CANS AND THE LIKE

BACKGROUND OF THE INVENTION

This invention relates to a holder for paint cans and analogous containers. It relates especially to a holder of this type which supports a can of paint or the like on the rungs of a ladder.

In the prior art, a variety of proposals has been made for supporting a can of paint from the rungs of a ladder by means of a holder into which the can is to be set. All of these proposals suffer from one or another disadvantage. Thus, devices are known which, when suspended from the rungs of a ladder, permit the can to swing, thus making for an unacceptable lack of stability. A proposal has been made for securing the holder on the ladder in such a way that it cannot swing, thereby avoiding the above mentioned disadvantage. However, in this latter case the holder must of necessity be so secured to the ladder that it is in the way of a person standing on — or climbing up and down — the ladder. Moreover, the holder is also located in such a position that it must be suspended above waist-height of the person on the ladder so as to gain access to the can in the holder; if the holder is suspended below the waist-height, it will be located between the ladder rungs and the legs of the person and will not only be difficult to access but will also be in constant danger of being dislodged.

SUMMARY OF THE INVENTION

It is an object of the invention to provide an improved holder for paint cans and the like, which avoids the aforementioned disadvantages.

More particularly, it is an object of the invention to provide such a holder which is to be supported on the rungs of a ladder.

It is another object of the invention to provide such a holder which can be suspended from the rungs of a ladder at any height relative to the body of a user standing on the ladder, and which will always afford substantially equally easy access and will not be in danger of becoming dislodged by movements of the user.

In pursuance of the objects, and of others which will hereafter become apparent, a feature of this invention resides in a holder for paint and analogous cans which, briefly stated, comprises a cage-like receptacle, at least a first hook extending upwardly from the receptacle for suspending the latter from a rung of a ladder, and a second hook extending laterally from the receptacle for hooking over another rung of the ladder so as to stabilize the receptacle. The hooks face in mutually opposite directions so that the receptacle can be located between the legs of a ladder, rather than on the outside of one of the legs, and both hooks can be either engaged with rungs of the same leg which are located at two different levels, or they can be connected with respective rungs of the two different legs whereby the rungs are again located at two different levels.

While the novel features which are considered characteristic of the invention are set forth in the claims, an embodiment of the invention — together with its method of use and its advantages — is set forth in the following description and the accompanying drawings.

BRIEF DESCRIPTION OF THE DRAWING

FIG. 1 is a side-elevational view of my novel holder suspended from rungs of a ladder; and FIG. 2 is a side view of FIG. 1, looking in the direction of the arrow II.

DESCRIPTION OF A PREFERRED EMBODIMENT

Referring now to the drawing in detail, it should be noted that only one leg 1 of a conventional two-leg step-ladder is shown. However, the location of the other leg will be understood by those having ordinary knowledge of such ladders. It is emphasized, incidentally, that the invention is equally well usable wtih one-leg ladders, i.e. the type which is not free-standing but must be leaned up against a support structure.

The leg 1 has a plurality of rungs located at different levels; of these, only two rungs 2 and 3 are shown for purposes of explanation.

My novel holder for paint and analogous cans (e.g. cans of pitch to close tree wounds) is designed to be supported on the rungs of the leg 1. Moreover, it is designed so that it will not — when so supported — be located at the outer side of the leg, i.e. the side on which a user will stand. This outer side is the side to which the arrow II points in FIG. 1.

My holder 4 has a receptacle 5 which is formed from a plurality of wire convolutions. The wire may be helically wound as shown in the drawing, so as to surround an interior space 6 in which a can is to be received. This need not be a saleable paint or analogous can; it might be an empty can of any type into which the user may wish to pour a quantity of paint or the like that is suited for his immediate needs. The can has been omitted for the sake of clarity.

A portion of the wire extends across the bottom of the space 6; this portion is identified with numeral 8 and forms a part of the bottom support for the can. Portion 8 merges into a wire portion 9 which extends upwardly along the receptable and is formed at the top of the receptacle into a laterally outwardly bent hook 10 which is to be placed over the lower rung 2. Another wire portion is bent to the shape of a letter U, so as to have two upright arms **11*a* and 11*b* which are connected by a portion 11*c* that constitutes the bight of the U (see FIG. 2). The portion 11*c* forms with the portion 8 the bottom support for a can accomodated in space 6. The upper ends of the arms 11*a* and 11*b* are bent over to form two hooks, of which only the hook 12*a* is shown in FIG. 1. These two hooks face in a direction opposite to the hook 10 (compare FIG. 1) and are to be hooked over the upper rung 3. The arms 11*a*, 11*b* are arranged substantially midway intermediate opposite sides of the receptacle 5, i.e. at diametrically opposite locations on the circumference of the receptacle. At all points of contact 7 between the convolutions 5, the portions 8, 9 and the arms 11*a*, 11*b***, the respectively contacting wires or wire portions are rigidly connected to one another, preferably by soldering.

Because of the arrangement of the hooks **10, 12*a* relative to one another, and the way they face, the novel holder can be mounted on that side of the ladder leg 1 which faces inwardly, i.e. away from a person standing on the ladder. The use of the plurality of hooks connected to the different rungs 2, 3 assures that the holder 4 is not only securely suspended from the ladder but is also stabilized on the same against swinging. The mounting of the holder at the inner side of the ladder leg 1 assures that the holder cannot interfere with the person — especially the legs — of a user standing on the ladder. Conversely, of course, accidental dislodging of the holder 4 by the movements of a user is also almost entirely impossible. Since the holder is located in the unobstructed area between the leg 1 and the other leg of the ladder or between the leg 1 and the support structure against which a one-leg ladder leans, access to the can in the holder 4 is freely possible at all times and substantially at all locations at which the holder 4** is secured to the ladder, subject only to the limitations of reach of the user.

Furthermore, when all hooks are connected to one and the same ladder leg, the holder is in upright position (as shown), which would not be possible if the hooks were provided at one and the same side of the receptacle, e.g. if they were all located at the side where the hook 10 is shown to be located.

Instead of being made from wire, the holder could also be made from other materials, of example from synthetic plastic material. The receptacle need not be of the type shown, but could also have a solid — or substantially solid — circumferential wall, so long as the location and orientation of the hooks 10, 12*a* is retained so that the holder can be secured at the inner side of the ladder leg, rather than at the outer side. It will be understood that it is this location and orientation of the hooks which also permits the use of the holder 4 in such a manner that one of the hooks is connected to a rung of one ladder leg whereas the other hook is connected to a rung of the other ladder leg. If desired or necessary, the arms 11*a* and 11*b* might be bent somewhat for the latter application. For this, it is advantageious if the length of the arms 11*a*, 11*b* is at least equal to the height of the receptacle 5, the word "length" referring to the free length above the upper edge of the receptacle.

While the invention has been described and illustrated by way of an exemplary embodiment, it should be understood that the novel aspects which are to be protected by U.S. Letters Patent are set forth in particular in the appended claims, and that all such modifications as might offer themselves readily to persons skilled in the art are to be encompassed by the scope of these claims.

I claim:

1. A holder for paint cans and the like, comprising in combination a cage-like receptacle having an upright central axis;

first hook means comprising a U-shaped wire having a bight portion extending across the bottom of said receptacle, and two upright arms extending upwardly along opposite sides of said receptacle and having upper end portions shaped as two first hooks extending upwardly from said receptacle at diametrically opposite locations at the circumference of said receptacle for suspending the same from a rung of a ladder and facing laterally away from one side of said axis; and second hook means including a second hook facing laterally away from the opposite side of said axis at a location on said circumference which is intermediate said diametrically opposite locations, for connection with another rung of said ladder so as to stabilize said receptacle thereon, said receptacle being capable of being secured to the rungs of said ladder at an inner side of a ladder leg which faces away from an outer side thereof at which a user of the ladder climbs up and down due to the hooks of said hook means facing away from said axis in mutually opposite lateral directions.

2. A holder as defined in claim 1, wherein said receptacle is formed from helical wire convolutions, and said hooks are formed from wire portions.

3. A holder as defined in claim 1, wherein said receptable comprises a wire portion having one section extending across the bottom of said receptacle and another section extending upwardly from said one section and having a free end portion which is formed in the region of the upper end of said receptacle into said second hook means.

4. A holder as defined in claim 1, wherein said arms have a length which is at least equal to the height of said receptacle.

* * * * *